US006197725B1

(12) United States Patent
Ohkawa et al.

(10) Patent No.: US 6,197,725 B1
(45) Date of Patent: Mar. 6, 2001

(54) HEAT-SENSITIVE RECORDING MATERIAL

(75) Inventors: Atsuhiro Ohkawa, Kanagawa; Hisao Yamada, Shizuoka-ken, both of (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/201,807

(22) Filed: Dec. 1, 1998

(30) Foreign Application Priority Data

Jan. 16, 1998 (JP) ..... 10-007067

(51) Int. Cl.[7] ..... B41M 5/28
(52) U.S. Cl. ..... 503/216; 503/215; 503/217
(58) Field of Search ..... 503/200, 216, 503/217, 218, 225, 201

(56) References Cited

U.S. PATENT DOCUMENTS

| | | | |
|---|---|---|---|
| 2,366,189 | 1/1945 | Hiemenz et al. | 260/239.6 |
| 2,525,319 | 10/1950 | SubbaRow et al. | 260/302 |
| 3,910,794 | 10/1975 | Buisine et al. | 96/91 R |
| 4,255,326 | 3/1981 | Giles et al. | 260/152 |

FOREIGN PATENT DOCUMENTS

| | | |
|---|---|---|
| 33 14 659 | 12/1983 | (DE) . |
| 0 432 705 | 6/1991 | (EP) . |
| 1071180 | 6/1967 | (GB) . |
| 4-118648 | 4/1992 | (JP) . |
| 7-128824 | 5/1995 | (JP) . |

OTHER PUBLICATIONS

Patent Abstracts of Japan vol. 009, No. 013 (P–328), Jan. 19, 1985, & JP 59 160136 A (RICOH KK) Sep. 10, 1984.
Database WPI Section Ch, Week 9910, Derwent Publications Ltd., London, GB; Class E13, AN 99–114223 XP002100882 & JP 10 337961 A (Fuji Photo Film Co., Ltd.) Dec. 22, 1998 * Abstract.

*Primary Examiner*—Bruce H. Hess
(74) *Attorney, Agent, or Firm*—Sughrue, Mion, Zinn, Macpeak & Seas, PLLC

(57) ABSTRACT

There is provided a coupler giving a magenta pigment excellent in hue using a diazonium salt compound which can be fixed at a wavelength around 420 nm. A heat-sensitive recording material comprising a substrate carrying thereon a heat-sensitive recording layer containing a diazonium salt compound and a coupler which develops color by reacting with said diazonium salt compound in heating, wherein said coupler comprises at least one compound represented by the following general formula (1):

General formula (1)

10 Claims, No Drawings

HEAT-SENSITIVE RECORDING MATERIAL

BACKGROUND OF THE INVENTION

1. Field of the Invention

The present invention relates to a recording material utilizing the heat sensitivity of a diazonium salt compound. More particularly, the present invention relates to a novel diazo heat-sensitive recording material developing red to magenta to violet, excellent in image storability and image fixing property.

2. Description of the Related Art

A diazonium salt compound has been used for a long time as a light recording material represented by diazo copy, and further, also applied recently for a recording material for which fixing of an image is required by utilizing a property that it is decomposed to lose function by the action of a light, and there has been suggested as a representative material a light fixing type heat-sensitive recording material by which a diazonium salt compound an a coupler are heated according to an image signal to be reacted to form an image, then the image is fixed by irradiation with a light (Koji Safuji, IMAGE ELECTRON INSTITUTE BOOK, vol. 11, pp. 290 to 296 (1982).

Further, there has been technical development of a diazonium salt compound such as improvement in storability and the like, and application to a full color heat-sensitive recording material has been reported (ELECTROPHOTOGRAPHY INSTITUTE BOOK, vol 26, pp. 115 to 125 (1987), FUJIFILM Research & Development, vol. 40, p. 13 (1995), Japanese Patent Application Publication (JP-B) No. 4-10,879 and the like).

In a lot of investigations for producing a full color sensitive material, magenta pigments are produced by using diazo compound having maximum absorption near 365nm. However, with increase of the abilities of a heat-sensitive recording material, it has been found that design in which sharpness is enhanced by placing a magenta material having visual sensitivity on the top layer is effective. For this design, it is necessary to use a coupler by which a magenta pigment is formed using a diazonium salt compound which can be fixed at a wavelength around 420 nm.

As a magenta coupler which, in heating, reacts with a diazonium salt compound which can be fixed at a wavelength around 420 nm, and develops color, there was used a coupler such as 1-hydroxycumarin or the like which develops color by reacting with a diazonium salt compound having the maximum absorption around 365 nm in heating. However, in this case, a pigment exhibiting very broad and brownish color was formed disadvantageously, and a magenta material could not be formed even if the substituent on the mother nucleus was changed.

For the purpose of improving this problem, a novel diazonium salt has been suggested in Japanese Patent Application No. 9-152,414. Hue obtained from a 1-hydroxycumarin coupler has not been satisfactory though it has been improved as compared with that obtained from conventional type diazo compounds.

SUMMARY OF THE INVENTION

An object of the present invention is to provide a coupler which provides a magenta pigment having excellent hue using a diazonium salt compound which can be fixed at a wavelength around 420 nm.

The object of the present invention can be accomplished by providing heat-sensitive recording materials shown below.

(1) A heat-sensitive recording material comprising a substrate carrying thereon a heat-sensitive recording layer containing a diazonium salt compound and a coupler which develops color by reacting with said diazonium salt compound in heating, wherein said coupler comprises at least one compound represented by the following general formula (1):

General formula (1)

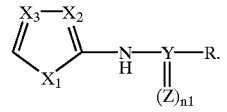

(Wherein, Y represents a carbon atom or sulfur atom. Z represents an oxygen atom or sulfur atom. R represents alkyl group, aryl group, heterocyclic group, alkoxy group, aryloxy group or amino group. n1 represents 1 when Y is a carbon atom and represents 1 or 2 when Y is a sulfur atom. When n1 represents 2, two Zs may be the same or different. $X_1$, $X_2$ and $X_3$ each independently represents an atom group required for forming a 5-membered aromatic heteroring. Wherein, there is no case in which two of $X_1$, $X_2$ and $X_3$ represent a carbon atom and the remaining one represents a nitrogen atom.).

(2) The heat-sensitive recording material according to (1), wherein said diazonium salt is a compound represented by the following general formula (2):

General formula (2)

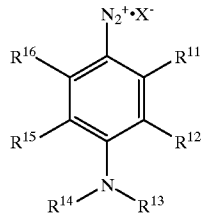

(Wherein, $R^{11}$ represents an alkylsulfenyl group, arylsulfenyl group, alkylsulfinyl group, arylsulfinyl group, alkylsulfonyl group, arylsulfonyl group, sulfamoyl group, alkoxycarbonyl group, carbamoyl group, carboxyl group, acyl group or cyano group. $R^{13}$ and $R^{14}$each independently represents a hydrogen atom, alkyl group or aryl group. $R^{12}$, $R^{15}$ and $R^{16}$ each independently represents a hydrogen atom, alkyl group, aryl group, alkoxy group or halogen atom. $X^-$ represents an anion. $R^{13}$and $R^{14}$, $R^{12}$ and $R^{13}$, or $R^{14}$ and $R^{15}$ may bond each other to form a ring.).

(3) The heat-sensitive recording material according to (1), wherein said diazonium salt is a compound represented by the following general formula (3):

General formula (3)

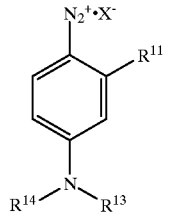

(Wherein, $R^{11}$ represents an alkylsulfenyl group, arylsulfenyl group, alkylsulfinyl group, arylsulfinyl group, alkylsulfonyl group, arylsulfonyl group, sulfamoyl group, alkoxycarbonyl group, carbamoyl group, acyl group or cyano group. $R^{13}$ and $R^{14}$ each independently represents a hydrogen atom, alkyl group or aryl group. $X^-$ represents an anion. $R^{13}$ and $R^{14}$ may bond each other to form a ring.).

(4) The heat-sensitive recording material according to (1) to (3), wherein said diazonium compound is encapsulated in a micro capsule.

DETAILED DESCRIPTION OF THE INVENTION

The heat-sensitive recording material of the present invention contains at least a diazonium salt compound and a coupler which develops color by reacting with said diazonium salt compound in heating on a substrate, and as said coupler, at least one compound represented by the general formula (1) is contained. The compound represented by the general formula (1) may have various tautomeric structures, and the compound represented by the general formula (1) of the present invention also include these tautomers.

The compound represented by the general formula (1) used as a coupler in the present invention will be described in detail below.

In the general formula (I), Y represents a carbon atom or sulfur atom, preferably a sulfur atom. Z represents an oxygen atom or sulfur atom, preferably, an oxygen atom. n1 represents 1 when Y is a carbon atom and represents 1 or 2 when Y is a sulfur atom. When n1 represents 2, two Zs may be the same or different. When Y is a sulfur atom, n1 represents preferably 2.

In the general formula (1), R represents an alkyl group (for example, a methyl group, isopropyl group, 2-ethylhexyl group, dodecyl group, hexadecyl group or cyclohexyl group), an aryl group (for example, a phenyl group, 1-naphthyl group or 2-naphthyl group), a heterocyclic group, an alkoxy group (for example, a methoxy group, isopropyloxy group, decyloxy group, hexadecyloxy group, 2-ethylhexyloxy group or cyclohexyloxy group), or an aryloxy group (for example, a phenoxy group, 1-naphthoxy group or 2-naphthoxy group), or an amino group (for example, an amino group, methylamino group, isopropylamino group, 1,1,3,3-tetramethylbutylamino group, 2-ethylhexylamino group, dodecylamino group, dibutylamino group, methylhexylamino group, dioctylamino group, cyclohexylamino group). The groups may further have a substituent, and examples of such substituent include an alkyl group, aryl group, alkoxy group, aryloxy group, acylamino group, sulfonylamino group, alkoxycarbonyl group, acyloxy group, carbamoyl group, sulfamoyl group, halogen atom and hydroxyl group. R represents preferably an alkyl group or aryl group. The substituent is preferably an alkyl group, alkoxy group, aryloxy group, acylamino group, sulfonylamino group, alkoxycarbonyl group, carbamoyl group or chlorine atom.

In the general formula (1), $X_1$, $X_2$ and $X_3$ each independently represents an atom group required for forming a 5-membered aromatic heteroring. Wherein, there is no case in which two of $X_1$, $X_2$ and $X_3$ represent a carbon atom and the remaining one represents a nitrogen atom.

$X_1$ preferably represents an oxygen atom, sulfur atom or —N($R_{31}$)—, further preferably a sulfur atom. $X_2$ preferably represents a nitrogen atom or —C($R_{32}$)═, further preferably a nitrogen atom. $X_3$ preferably represents a nitrogen atom or —C($R_{33}$)═, further preferably —C($R_{33}$)═. $R_{31}$ represents a hydrogen atom, alkyl group or aryl group, and preferably represents an alkyl group. These groups may further have a substituent, and this substituent represents the same substituent for R. $R_{32}$ and $R_{33}$ each independently represents an alkyl group, aryl group, heterocyclic group, acylamino group, alkoxy group, aryloxy group, alkylthio group, arylthio group, acyl group, sulfonyl group, sulfonylamino group, cyano group, alkoxycarbonyl group, aryloxycarbonyl group, carbamoyl group, halogen atom and the like, and preferably represents an alkyl group, aryl group or heterocyclic group. These groups may further have a substituent, and this substituent represents the same substituent for R.

As typical examples of the 5-membered aromatic heteroring formed by $X_1$, $X_2$ and $X_3$ in the general formula (1), the following (H1 to H11) are listed, among them, H1, H2, H3, H4, H5, H9 and H11 are preferably listed, and H1, H2 and H9 are further preferable, and H1 is most preferable.

H1

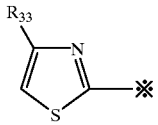

H2

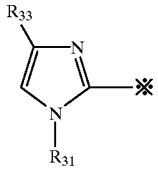

H3

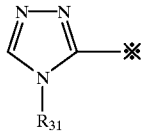

H4

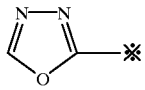

H5

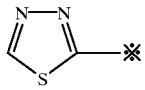

H6

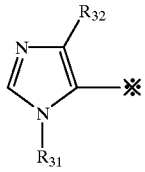

H7

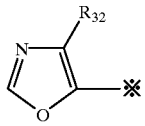

H8

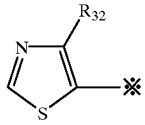

-continued

H9

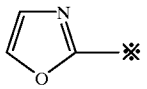

H10

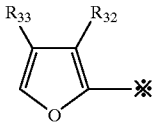

H11

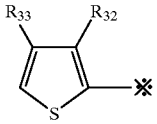

(Wherein, ※ denotes bonding position with

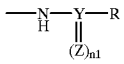

in general formula (1)).

Specific examples of the compound represented by the general formula (1) used as the coupler of the present invention include, but are not limited to, the following (K-1 to K-76).

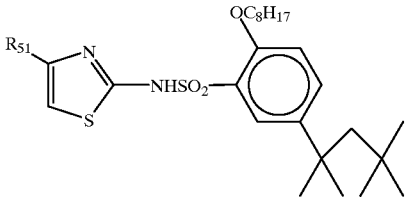

(K-1)

$R_{51}$ = 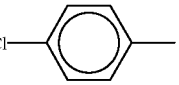

(K-2)

$R_{51}$ = (n-)$C_8H_{17}O$ 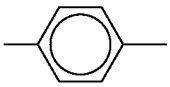

(K-3)

$R_{51}$ = NC 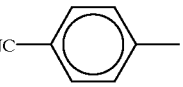

(K-4)

$R_{51}$ = 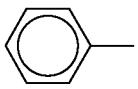

(K-5)

$R_{51}$ = Cl 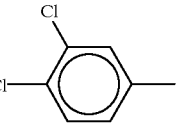

(K-6)

$R_{51}$ = 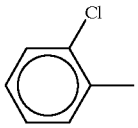

-continued (K-7)

$R_{51}$ = 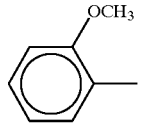

(K-8)

$R_{51}$ = 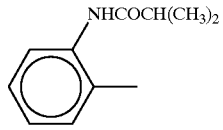

(K-9)

$R_{51}$ = 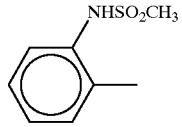

(K-10)

$R_{51}$ = 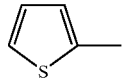

(K-11)

$R_{51}$ = 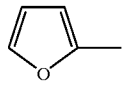

(K-12)

$R_{51}$ = 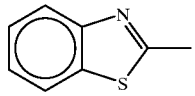

(K-13)

$R_{51}$ = 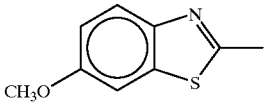

(K-14)

$R_{51}$ = 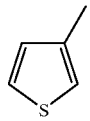

(K-15)

$R_{51}$ = $C_6H_{13}(C_8H_{17})CHCH_2OC(=O)C(CH_3)_2$—

(K-16)

$R_{51}$ = $(CH_3)_2CH$—

(K-17)

$R_{51}$ = 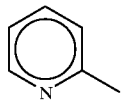

(K-18)

$R_{51}$ = 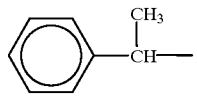

-continued
(K-19)
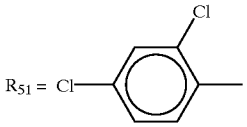
(K-20)
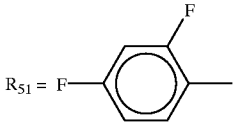
(K-21)
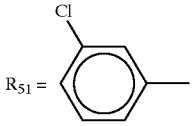
(K-22)
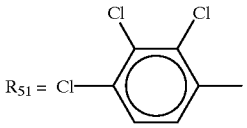
(K-23)
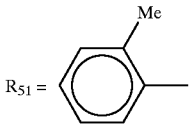
(K-24)
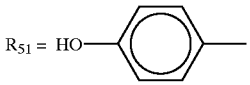
(K-25)
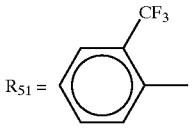
(K-26)
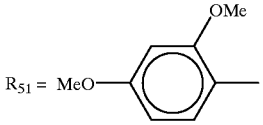
(K-27)
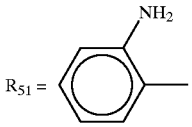
(K-28)
$R_{51}$ = Me
(K-29)
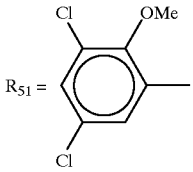
-continued
(K-30)
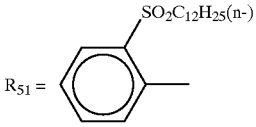
(K-31)
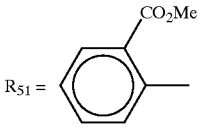
(K-32)
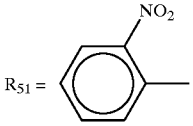
(K-33)
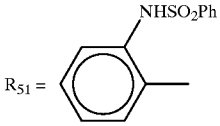
(K-34)
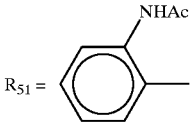
(K-35)
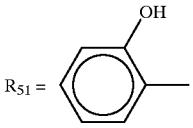
(K-36)
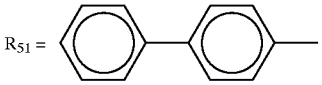
(K-37)
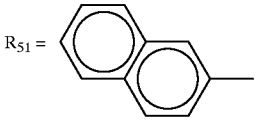
(K-38)
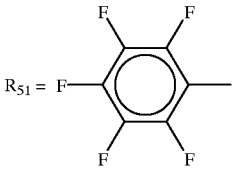
(K-39)
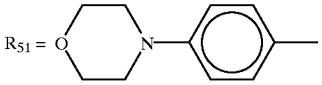

-continued
(K-40)
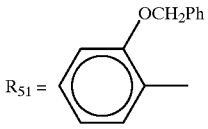
(K-41)
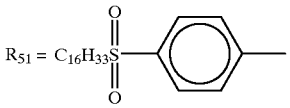
(K-42)
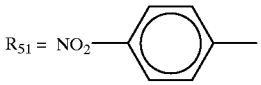
(K-43)
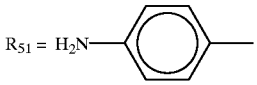
(K-44)
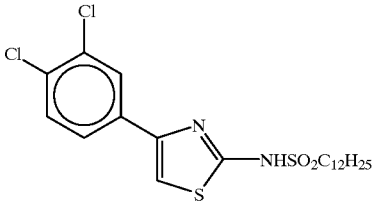
(K-45)
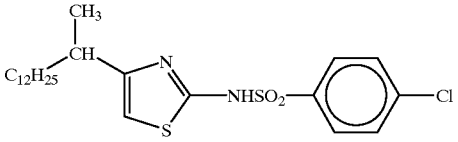
(K-46)
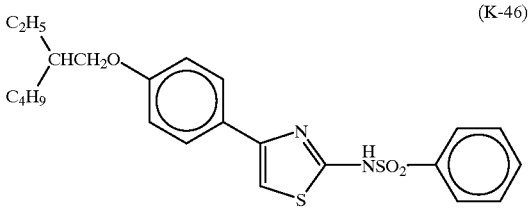
(K-47)
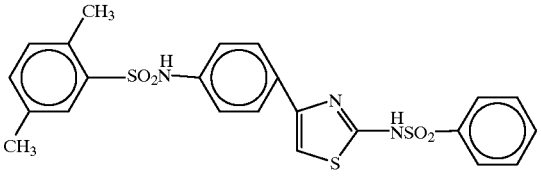
(K-48)
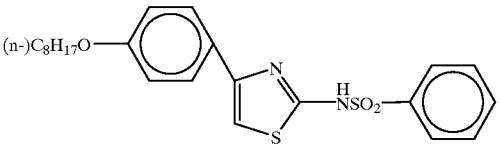
-continued
(K-49)
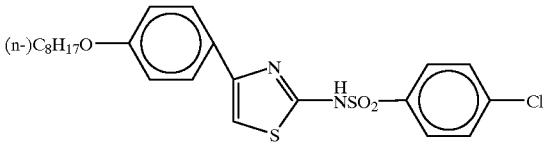
(K-50)
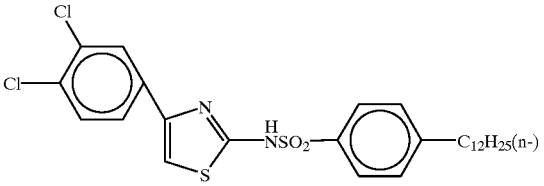
(K-51)
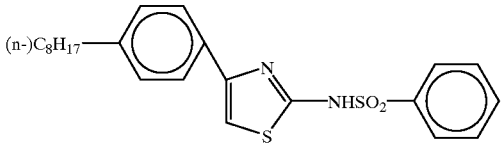
(K-52)
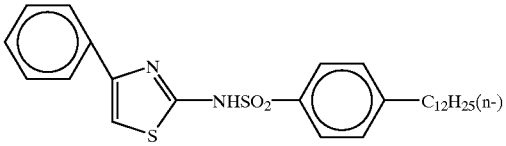
(K-53)
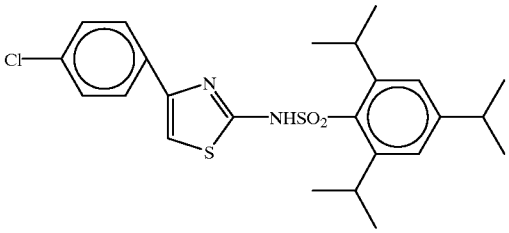
(K-54)
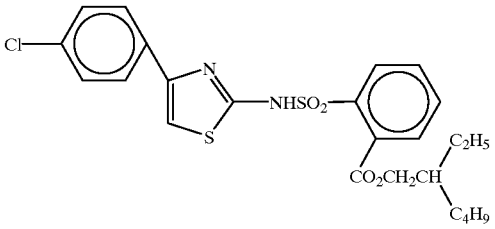
(K-55)
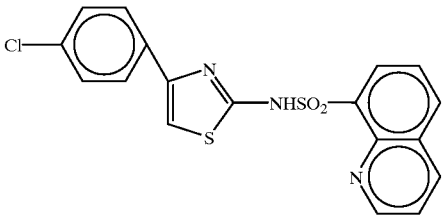

-continued
(K-56)
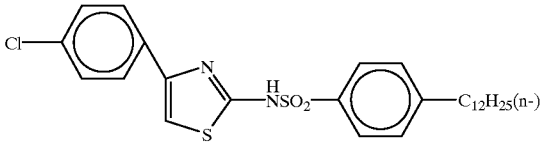
(K-57)
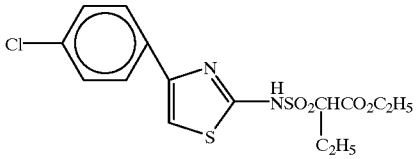
(K-58)
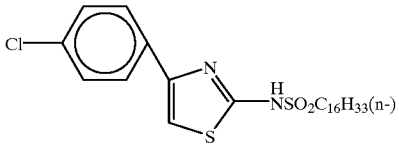
(K-59)
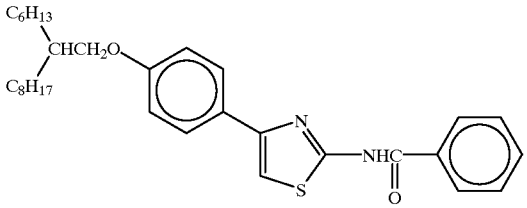
(K-60)
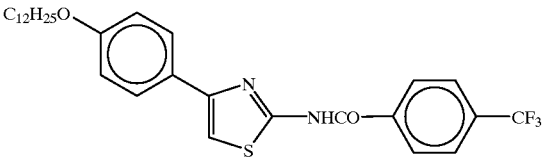
(K-61)
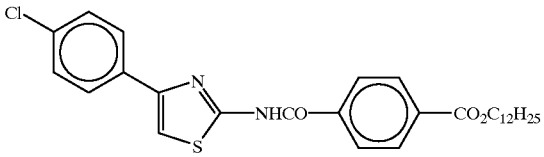
(K-62)
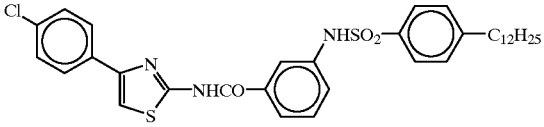
(K-63)
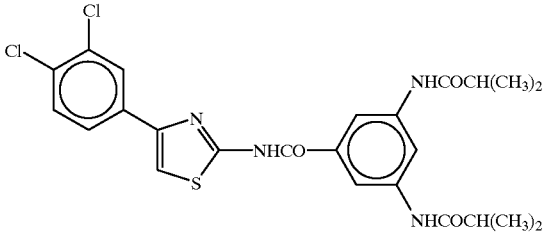
-continued
(K-64)
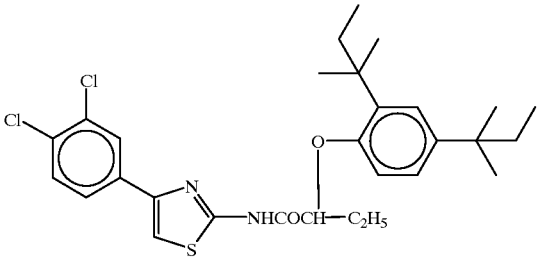
(K-65)
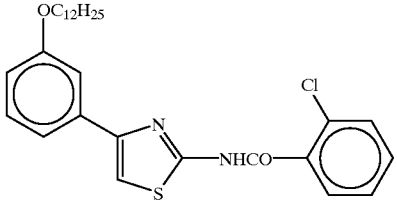
(K-66)
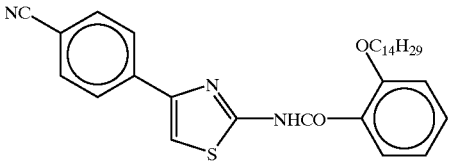
(K-67)
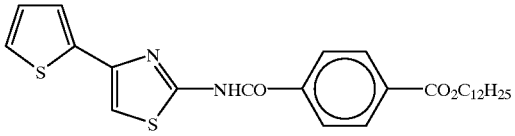
(K-68)
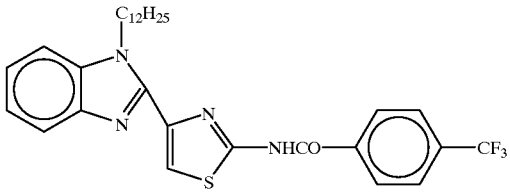
(K-69)
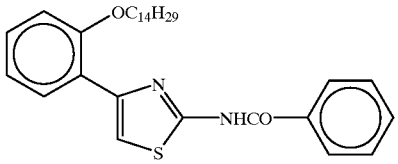
(K-70)
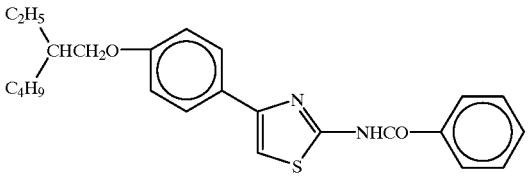

-continued (K-71)

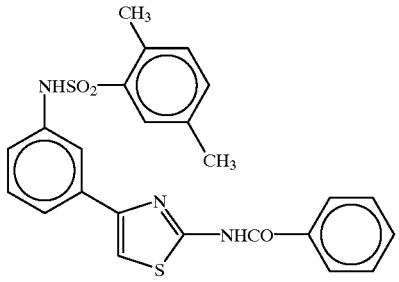

(K-72)

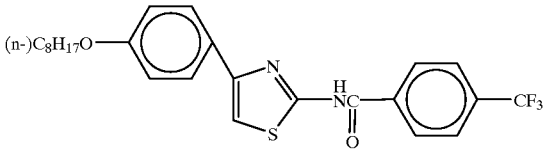

(K-73)

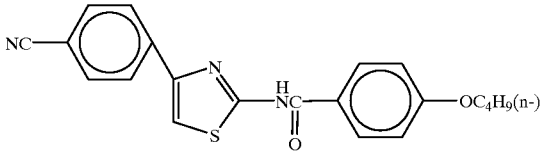

(K-74)

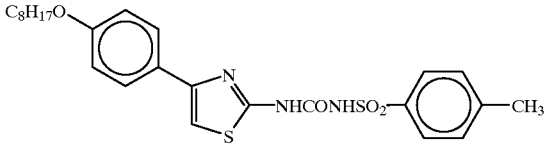

(K-75)

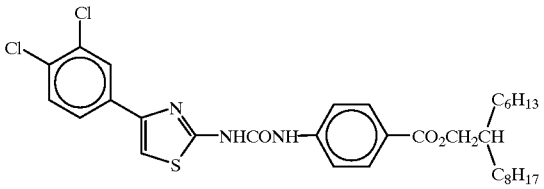

(K-76)

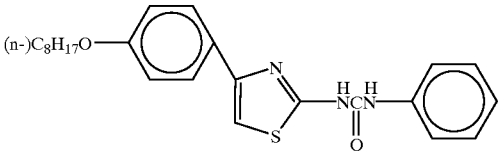

The coupler of the present invention can be synthesized by various methods, and typical synthesizing examples are shown below.

SYNTHESIS EXAMPLE 1

(Synthesis of exemplary compound K-1)

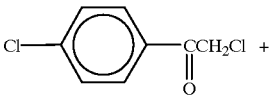

1a

-continued

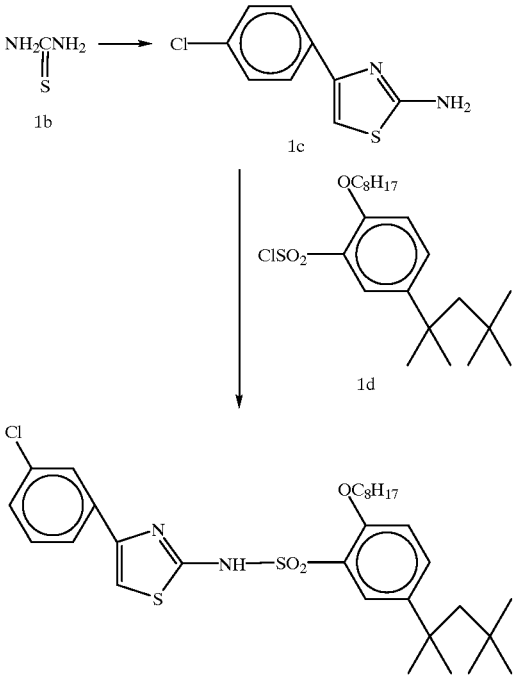

Exemplary compound (K-1)

1a (50 g) and 1b (20 g) were refluxed in 2-propanol (500 ml) for 2 hours. The reaction solution was cooled with ice, and the deposited crystal was filtered, washed with cooled 2-propanol, and dried in air. This crystal was dispersed in an aqueous sodium hydrogen carbonate solution, and stirred for one hour. Then, the crystal was filtered, washed with water, and dried to obtain 52 g (94%) of 1c.

A mixture of 1c (21 g) and tetrahydrofuran (300 ml) was cooled with ice, then, to this was added 1d (42 g), then, an oil dispersion of NaH (content: 40%) was added so that the temperature of the reaction solution was kept at 15° C. or lower. Then, the mixture was further stirred for 30 minutes, to this was added 1N hydrochloric acid (150 ml) and ethyl acetate (300 ml). The aqueous layer was separated, the organic layer was further washed with water. The organic layer was dried with magnesium sulfate, concentrated, then, crystallized from hexane, and the resulted crystal was further crystallized from ethyl acetate (40 ml) and hexane (300 ml) to obtain 38 g (64%) of the exemplary compound K-1. Melting point: 116 to 117° C.

SYNTHESIS EXAMPLE 2

(Synthesis of exemplary compound K-59)

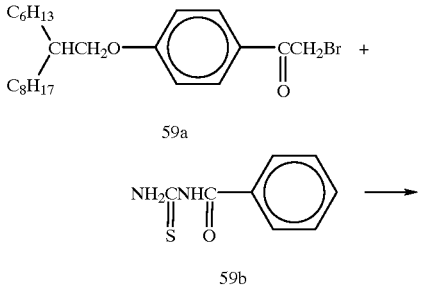

59a

59b

-continued

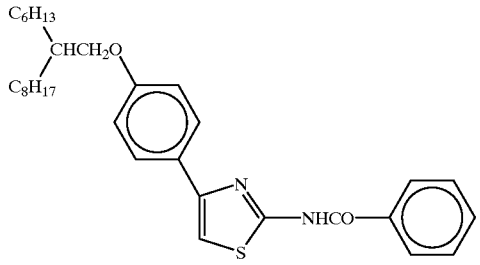

Exemplary compound (K-59)

59a (4.4 g) and 59b (1.8 g) were mixed in 2-propanol (30 ml), and the mixture was refluxed for 3 hours. The solvent was distilled off, then, dissolved in ethyl acetate (50 ml), washed with an aqueous sodium hydrogen carbonate solution. The organic layer was concentrated, then, the residue was purified on a silica gel column using a mixed solvent of ethyl acetate and hexane, toobtain4.5 g (87%) of the exemplary compound K-59.

The content of the compound represented by the general formula (1) which is usedas the coupler of the present invention in the light sensitive layer is preferably in the range from 0.02 to 5 g/m$^2$, further preferably in the range from 0.1 to 4 g/m$^2$. When the content is lower than 0.02 g/m$^2$, color developing property tends to be insufficient, and when over 5 g/m$^2$, coating aptitude tends to be problematical.

The diazonium salt compound used in the heat-sensitive recording material of the present invention is a compound represented by the following general formula (A), and a compound which causes coupling reaction with a coupler to develop color by heating and is decomposed by the action of a light. The maximum absorption wavelength of them can be controlled by the position and kind of the Ar part.

$$Ar—N_2^+X^- \qquad \text{General formula (A)}$$

(In the general formula (A), Ar represents an aromatic part, and $X^-$ represents and acid anion.)

Specific examples of the diazonium salt compound forming a salt include 4-(p-tolylthio)-2,5-dibutoxybenzenediazonium, 4-(4-chlorophenylthio)-2,5-dibutoxybenzenediazonium, 4-(N,N-dimethylamino) benzenediazonium, 4-(N,N-diethylamino) benzenediazonium, 4-(N,N-dipropylamino) benzenediazonium, 4-(N-methyl-N-benzylamino) benzenediazonium, 4-(N,N-dibenzylamino) benzenediazonium, 4-(N-ethyl-N-hydroxyethylamino) benzenediazonium, 4-(N,N-diethylamino)-3-methoxybenzenediazonium, 4-(N,N-dimethylamino)-2-methoxybenzenediazonium, 4-(N-benzoylamino)-2,5-diethoxybenzenediazonium, 4-morpholino-2,5-dibutoxybenzenediazonium, 4-anilinobenzenediazonium, 4-[N-(4-methoxybenzoyl)amino]-2,5-diethoxybenzenediazonium, 4-pyrrolidino-3-ethylbenzenediazonium, 4-[N-(1-methyl-2-(4-methoxyphenoxy)ethyl)-N-hexylamino]-2-hexyloxybenzenediazonium, 4-[N-(2-(4-methoxyphenoxy) ethyl)-N-hexylamino]-2-hexyloxybenzenediazonium, 2-(1-ethylpropyloxy)-4-[di-(di-n-butylaminocarbonylmethyl) amino]benzenediazonium, and the like.

The maximum absorption wavelength $\lambda_{max}$ of the diazonium salt compound used in the present invention is preferably 450 m or less from the viewpoint of the effect, and more preferably from 290 to 440 nm. It is not preferable that the diazonium salt compound has $\lambda_{max}$ at longer wavelength side than the above-described wavelength range from the viewpoint of storability before use, and it is also not preferable that the diazonium salt compound has $\lambda_{max}$ at shorter wavelength side than the above-described wavelength range from the viewpoints of image fixing ability and image storability.

It is desirable that the diazonium salt compound used in the present invention has 12 or more carbon atoms, exhibits solubility in water was of 1% or less and solubility in ethyl acetate of 5% or more.

It is more preferable to use, among these diazonium salt compounds, at least one of diazonium salt compounds represented by the general formula (2) and general formula (3) from the viewpoints of the hue of a pigment formed, image concentration, image fixing ability and image stability in combination with a specific coupler of the present invention.

The diazonium salt compounds represented by the general formulae (2) and (3) will be described in detail below.

In the general formulae (2) and (3), the alkylsulfenyl group and arylsulfenyl group represented by $R^{11}$ may further have a substituent, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

Particularly preferable are an alkylsulfenyl group having 1 to 30 carbon atoms in total (for example, a methylthio group, ethylthio group, butylthio group, hexylthio group, octylthio group, dodecylthio group, octadecylthio group, cyclohexylthio group, 2-ethylhexylthio group, 2-(N,N-dioctylcarbamoyl)ethylthio group), an allylthio group, a benzylthio group, and an arylsulfenyl group having 6 to 30 carbon atoms in total (for example, a phenylthio group, 4-methoxyphenylthio group,4- (2-ethylhexyloxy)phenylthio group, 2-butoxycarbonylphenylthio group, 2-chlorophenylthio group, 4-chlorophenylthio group, 4-methylphenylthio group).

In the general formulae (2) and (3), the alkylsulfinyl group andarylsulfinyl group represented by $R^{11}$ may further have a substituent, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

Particularly preferable are an alkylsulfinyl group having 1 to 30 carbon atoms in total (for example, a methylsulfinyl group, ethylsulfinyl group, butylsulfinyl group, hexylsulfinyl group, octylsulfinyl group, dodecylsulfinyl group, octadecylsulfinyl group, cyclohexylsulfinyl group, 2-ethylhexylsulfinyl group, 2-(N,N-dioctylcarbamoyl) ethylsulfinyl group), an allylsulfinyl group, a benzylsulfinyl group, and an arylsulfinyl group having 6 to 30 carbon atoms in total (for example, phenylsulfinyl group, 4-methoxyphenylsulfiny group, 4-( 2-ethylhexyloxy) phenylsulfinyl group, 2-butoxycarbonylphenylsulfinyl group, 2-chlorophenylsulfinyl group, 4-chlorophenylsulfinyl group, 4-methylphenylsulfinyl group).

In the general formulae (2) and (3), the alkylsulfonyl group and arylsulfonyl group represented by $R^{11}$ may further have a substituent, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

Particularly preferable are an alkylsulfonyl group having 1 to 30 carbon atoms in total (for example, a methylsulfonyl group, ethylsulfonyl group, butylsulfonyl group, hexylsulfonyl group, octylsulfonyl group, dodecylsulfonyl group, octadecylsulfonyl group, cyclohexylsulfonyl group, 2-ethylhexylsulfonyl group, 2-(N,N-dioctylcarbamoyl) ethylsulfonyl group), an allylsulfonyl group, a benzylsulfonyl group, and an arylsulfonyl group having 6 to 30 carbon atoms in total (for example, phenylsulfonyl group, 4-methoxyphenylsulfony group, 4-(2-ethylhexyloxy) phenylsulfonyl group, 2-butoxycarbonylphenylsulfonyl group, 2-chlorophenylsulfonyl group, 4-chlorophenylsulfonyl group, 4-methylphenylsulfonyl group).

In the general formulae (2) and (3), the sulfamoyl group represented by $R^{11}$ may be substituted or unsubstituted, and a N,N-dialkyl (or aryl)sulfamoyl group having 3 to 30 carbon atoms in total is preferable, and preferable examples are a N,N-dimethylsulfamoyl group, N,N-diethylsulfamoyl group, N,N-dibutylsulfamoyl group, N,N-dioctylsulfamoyl group, N,N-bis(2-ethylhexyl)sulfamoyl group, N-ethyl-N-benzylsulfamoyl group, N-ethyl-N-butylsulfamoyl group, piperidinosulfonyl group, pyrrolidinosulfonyl group, morpholinosulfonyl group, 4-octanoylpiperazinosulfonyl group and hexamethyleneiminosulfonyl group.

In the general formulae (2) and (3), the alkoxycarbonyl group represented by $R^{11}$ may be substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

An alkoxycarbonyl group having 2 to 30 carbon atoms in total is preferable, and preferable examples are a methoxycarbonyl group, ethoxycarbonyl group, butoxycarbonyl group, octyloxycarbonyl group, dodecyloxycarbonyl group, cyclohexyloxycarbonyl group, octadecyloxycarbonyl group, 2-ethoxyethoxycarbonyl group, 2-chloroethoxycarbonyl group, 2-phenoxyethoxycarbon1 group, and benzyloxycarbonyl group.

In the general formulae (2) and (3), the carbamoyl group represented by $R^{11}$ may be substituted or unsubstituted, and N,N-dialkyl(or aryl)carbamoyl group is preferable, and this alkyl group (or aryl group) maybe substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

A N,N-dialkyl(or aryl)carbamoyl group having 3 to 30 carbon atoms in total is particularly preferable, and preferable examples are a N,N-dimethylcarbamoyl group, N,N-diethylcarbamoyl group, N,N-dibutylcarbamoyl group, N,N-dioctylcarbamoyl group, N,N-bis(2-ethylhexyl) carbamoyl group, N-ethyl-N-benzylcarbamoyl group, N-ethyl-N-butylcarbamoyl group, piperidinocarbonyl group, pyrrolidinocarbonyl group, morpholinocarbonyl group, 4-octanoylpiperazinocarbonyl group and hexamethyleneiminocarbonyl group.

In the general formulae (2) and (3), the acyl group represented by $R^{11}$ is preferably an aliphatic acyl group, aromatic acyl group or heterocyclic acyl group, and these may be substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic acid group, acyl group and heterocyclic group.

An acyl group having 2 to 30 carbon atoms in total is particularly preferable, and preferable examples are an acetyl group, butanoyl group, octanoyl group, benzoyl group, 4-methoxybenzoyl group and 4-chlorobenzoyl group.

In the general formulae (2) and (3), the alkyl group represented by $R^{13}$ and $R^{14}$ may be substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

An alkyl group having 1 to 30 carbon atoms in total is particularly preferable, and preferable examples are a methyl group, ethyl group, butyl group, octyl group, 2-ethylhexyl group, decyl group, dodecyl group, octadecyl group, 2-hydroxyethyl group, 2-benzoyloxyethyl group, 2-(4-butoxyphenoxy)ethyl group and benzyl group, 4-methoxybenzyl group.

In the general formulae (2) and (3), the aryl group represented by $R^{13}$and $R^{14}$ may be substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

An aryl group having 6 to 30 carbon atoms in total is particularly preferable, and preferable examples are a phenyl group, 4-methoxyphenyl group and 4-chlorophenyl group.

In the general formula (2), the alkyl group represented by $R^{12}$, $R^{15}$ and $R^{16}$ may be substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

An alkyl group having 1 to 30 carbon atoms in total is particularly preferable, and preferable examples are a methyl group, ethyl group, propyl group, isopropyl group, butyl group, tert-butyl group, benzyl group, α-methylbenzyl group, chloroethyl group, trichloromethyl group and trifluoromethyl group, and a particularly preferable example is a methyl group.

In the general formula (2), the aryl group represented by $R^{12}$, $R^{15}$ and $R^{16}$ may be substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

An aryl group having 6 to 30 carbon atoms in total is particularly preferable, and preferable examples are a phenyl group, 4-methoxyphenyl group and 4-chlorophenyl group.

In the general formula (2), the alkoxy group represented by $R^{12}$, $R^{15}$ and $R^{16}$ may be substituted or unsubstituted, and examples of this substituent preferably include a phenyl group, halogen atom, alkoxy group, aryloxy group, alkoxycarbonyl group, acyloxy group, acylamino group, carbamoyl group, cyano group, alkylsulfenyl group, arylsulfenyl group, alkylsulfinyl group, arylsulfinyl group, alkylsulfonyl group, arylsulfonyl group, sulfonamide group, sulfamoyl group, carboxyl group, sulfonic group, acyl group and heterocyclic group.

An alkoxy group having 1 to 30 carbon atoms in total is particularly preferable, and preferable examples are a methoxy group, ethoxy group, butoxy group, hexyloxy group, octyloxy group, decyloxy group, octadecyloxy group, 2-ethoxyethoxy group, 2-chloroethoxy group and 2-phenoxyethoxy group.

In the general formula (2), the halogen atom represented by $R^{12}$, $R^{15}$ and $R^{16}$ is preferably a fluorine atom, chlorine atom or iodine atom, and a chlorine atom isparticularly preferable.

When $R^{13}$ and $R^{14}$, $R^{12}$ and $R^{13}$, or $R^{14}$ and $R^{15}$ bond each other to form a ring, a 5 to 7-membered ring is preferably formed.

When $R^{13}$ and $R^{14}$ bond each other to form a ring, a 5 to 7-membered ring is preferably formed, and preferable examples include a pyrrolidino group, piperidino group, morpholino group, 4-acylpiperazino group, 4-sulfonylpiperazino group and hexamethyleneimino group. Further, it may also allowable that $R^{11}$, $R^{12}$, $R^{13}$, $R^{14}$, $R^{15}$ and $R^{16}$ are a substituent having a diazoniophenyl group as a substituent, and form a bis compound or a higher multimer.

In the general formulae (2) and (3), the anion represented by $X^-$0 is preferably a hexafluorophosphate ion, borohydrofluorate ion, chloride ion or sulfate ion as an inorganic anion, and a hexafluorophosphate ion and a borohydrofluorate ion are particularly preferable. Examples of organic anions include preferably a polyfluoroalkylcarboxylate ion, polyfluoroalkylsulfonate ion, tetraphenylborate ion, aromatic carboxylate ion and aromatic sulfonate ion.

Specific examples of the diazonium salt compound represented by the general formula (2) or (3) of the present invention include, but are not limited to, the following compounds (A-1 to A-47).

A-1

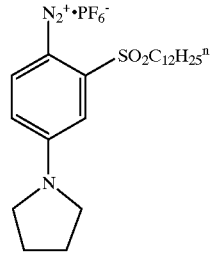

A-2

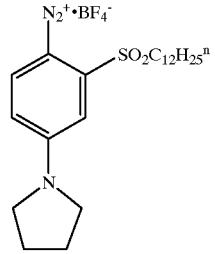

A-3

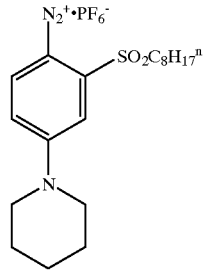

A-4

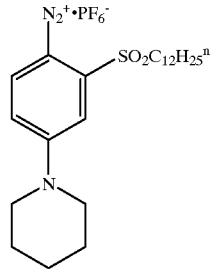

A-5

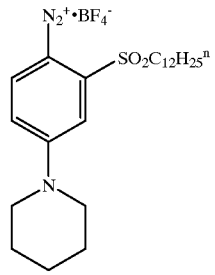

-continued
A-6
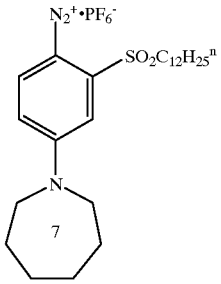
A-7
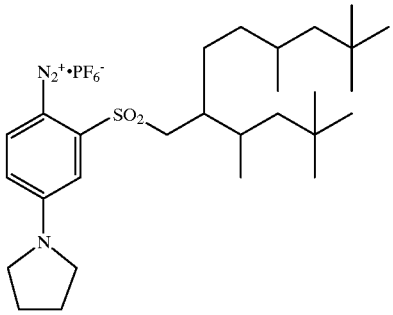
A-8
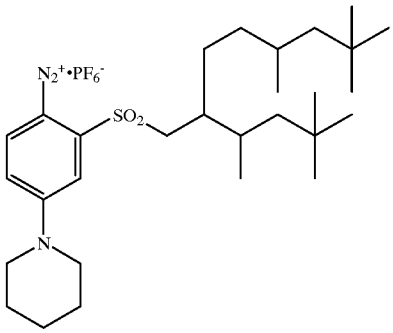
A-9
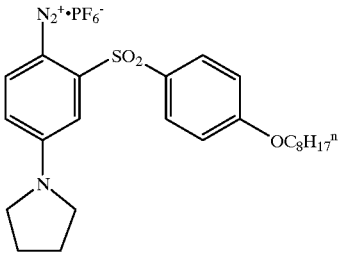
A-10
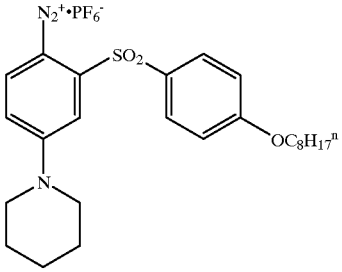
-continued
A-11
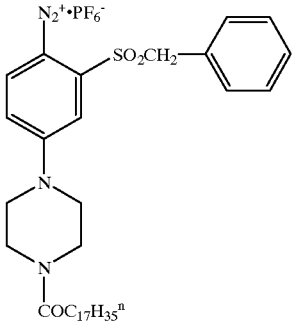
A-12
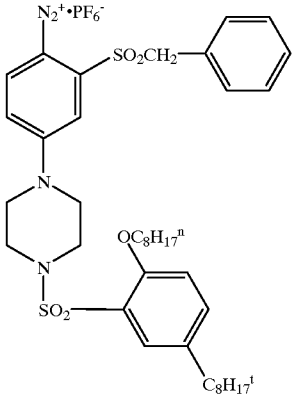
A-13
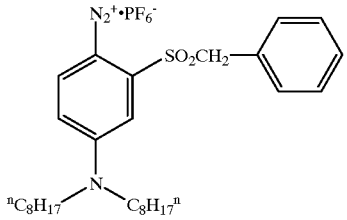
A-14
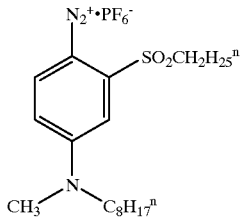
A-15
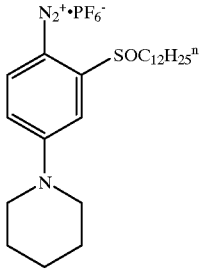

-continued
A-16
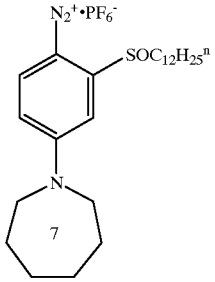
A-17
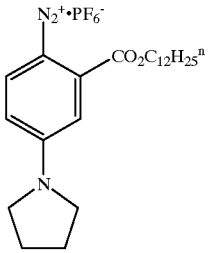
A-18
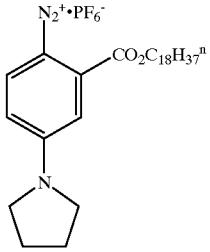
A-19
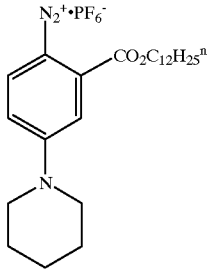
A-20
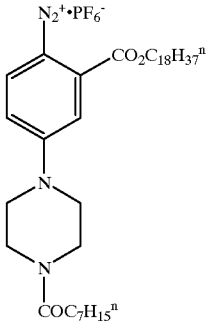
-continued
A-21
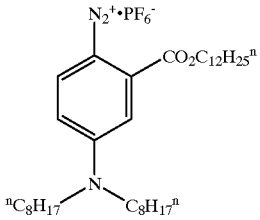
A-22
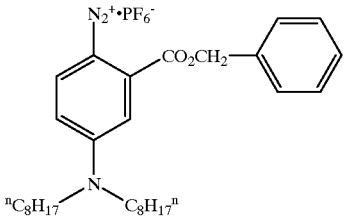
A-23
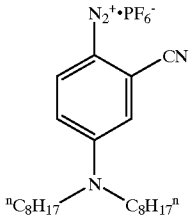
A-24
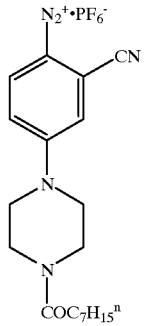
A-25
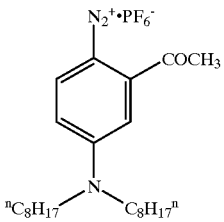

-continued
A-26
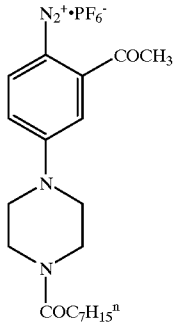
A-27
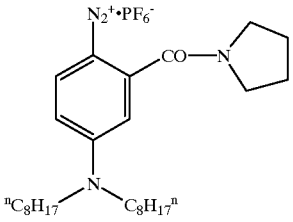
A-28
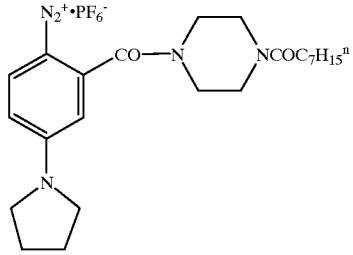
A-29
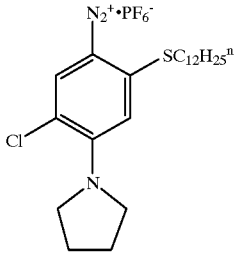
A-30
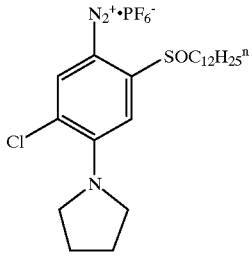
-continued
A-31
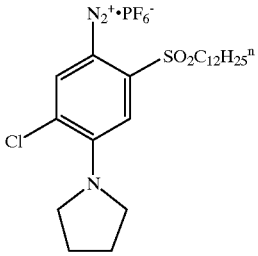
A-32
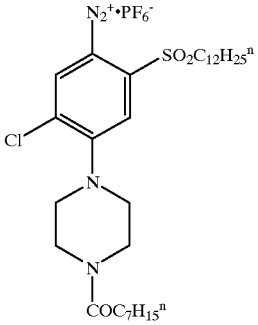
A-33
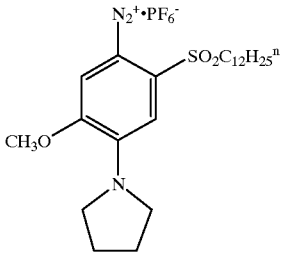
A-34
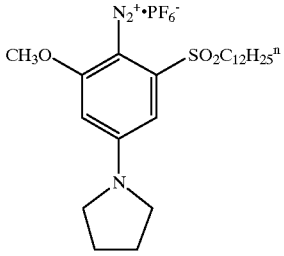
A-35
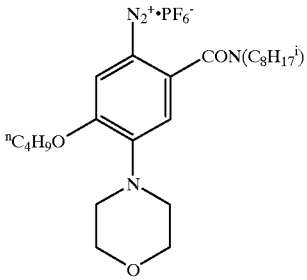

-continued
A-36
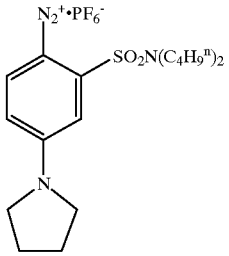
A-37
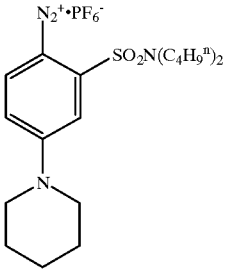
A-38
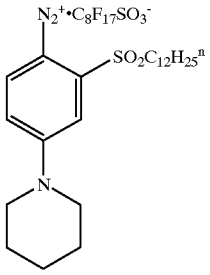
A-39
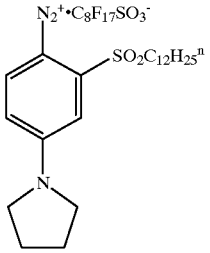
A-40
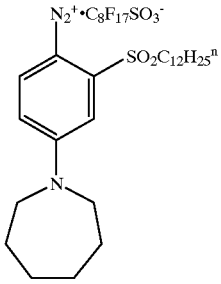
-continued
A-41
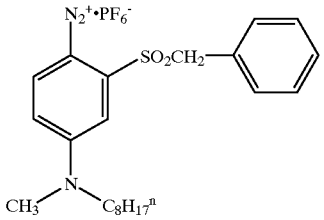
A-42
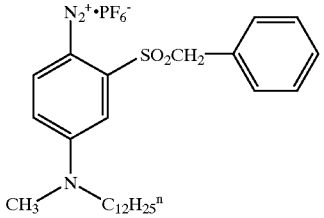
A-43
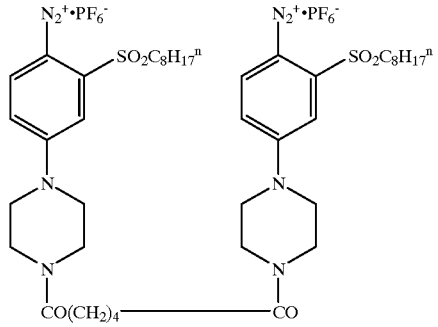
A-44
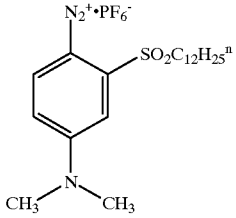
A-45
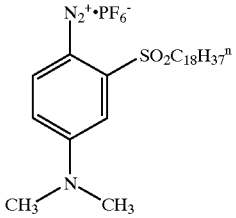
A-46
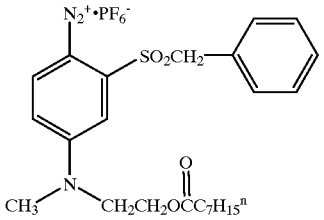

-continued

A-47

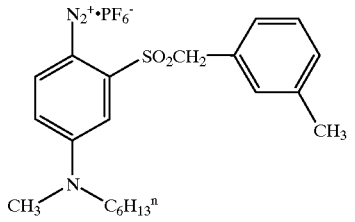

The diazonium salt compound represented by general formula (2) or (3) can be produced by a known method. That is, it is obtained by diazotization of corresponding aniline using sodium nitrite, nitrosylsulfuric acid, isoamyl nitrite and the like in an acidic solvent. As this example, a synthesis example of the exemplary compound A-1 is shown below.

[Synthesis example of exemplary compound A-1]

(Synthesis example of 2-dodecylsulfonyl-4-pyrrolidinonitrobenzene)

A mixture of 27.5 g of 2-dodecylsulfonyl-4-chloronitrobenzene, 5.5 g of pyrrolidine, 138 g of potassium carbonate and 70 ml of dimethylacetamide was stirred for 3 hours at 90° C. To this reaction mixture was added 210 ml of water, and the precipitated crystal was collected by filtration and recrystallized with acetonitrile to obtain 12.7 g of 2-decylsulfonyl-4-pyrrolidinonitrobenzene.

(Synthesis of 2-dodecylsulfonyl-4-pyrrolidinoaniline)

19.5 g of an iron powder, 2.0 g of ammonium chloride, 35 ml of water and 105 ml of isopropanol were heated and refluxed, and to this was added 20.7 g of 2-dodecylsulfonyl-4-pyrrolidinoaniline portionwise. The reaction mixture was heated to reflux for 30 minutes, then, cooled to room temperature, and the insoluble materials were separated off by filtration using Celite. The filtrate was concentrated, then purified by column chromatography to obtain 11.6 g of 2-dodecylsulfonyl-4-pyrrolidinoaniline.

[Synthesis example of exemplary compound A-2]

To a mixture cooled to 0° C. of 11.6 g of 2-dodecylsulfonyl-4-pyrrolidinoaniline, 7.5 ml of concentrated hydrochloric acid and 60 ml of methanol was added dropwise a solution of 2.3 g of sodium nitrite and 12 ml of water. The mixture was stirred for one hour at 10° C., then, to this reaction mixture was added 6.6 g of potassium hexafluorophosphate and 60 ml of water and the resulted mixture was stirred for one hour at room temperature. The precipitated crystal was collected by filtration and washed sequentially with water and isopropanol, then, crystallized from a mixed solvent of ethyl acetate and hexane. After drying, 10.1 g of the exemplary compound A-2 was obtained. Ultraviolet and visible light absorption spectrum in methanol exhibited $\lambda_{max}$ of 392 nm and $\epsilon$ of $3.06\times10^4$.

The compound represented by the general formula (2) or (3) may be any of an oily substance and crystalline substance, and a crystalline substance is preferable in view of handling.

The compound represented by the general formula (2) or (3) may be used alone or in combination of two or more.

When the compound represented by the general formula (2) or (3) is used in a heat-sensitive recording material, it is preferable to use it in an amount in the range from 0.02 to 5 g/m$^2$ in a heat-sensitive recording material, and it is particularly preferable touse it in an amount in the range from 0.1 to 4 g/m$^2$ from the viewpoint of developed color concentration.

For stabilization of the above-described diazonium salt compound, it is also possible that the diazonium salt compound is stabilizedby forming a complex compound using zinc chloride, cadmium chloride, tin chloride and the like. These diazonium salt compounds may be used alone or in combination of two or more.

In the heat-sensitive recording material of the present invention, it is preferable that the diazonium salt compound is encapsulated in a micro capsule for enhancing the storability before use. For creating such constitution, known methods can be used. It is necessary that a polymer substance forming the capsule wall is impermeable at normal temperature and permeable in heating. A polymer having a glass transition temperature from 60 to 200° C. is particularly preferable. Examples thereof include a polyurethane, polyurea, polyamide, polyester, urea formaldehyde resin, melamine resin, polystyrene, styrene methacrylate copolymer, styrene acrylate copolymer and mixed system thereof.

As the micro capsule forming method, an interfacial polymerization method and internal polymerization method are suitable. Details of the capsule forming method and specific examples of reactants are described in U.S. Pat. Nos. 3,726,804 and 3,796,669. For example, when a polyurea and polyurethane are used as capsule wall materials, a polyisocyanate and a second substance (for example, polyol, polyamine) which reacts with it to form a capsule wall are mixed in an aqueous medium or an oily medium to be capsulated, these are emulsified and dispersed in water, then, heat the emulsion to cause polymer-forming reaction at the oil drop interface to form a micro capsule wall. Also when the addition of the second substance is omitted, a polyurea is formed.

In the present invention, it is preferable that the polymer substance forming a micro capsule wall is at least one selected from polyurethanes and polyureas.

A method for producing a micro capsule (polyurea polyurethane wall) containing a diazonium salt compound in the present invention will be described below.

First, a diazonium salt compound is dissolved or dispersed in a hydrophobic organic solvent which will be a core of a capsule. As the organic solvent in this case, an organic solvent having a boiling point of 100 to 300° C. is preferable. Into the core solvent is further added a polyvalent isocyanate as a wall material (oil phase).

On the other hand, for forming an aqueous phase, first an aqueous solution into which a water-soluble polymer such as polyvinyl alcohol, gelatin and the like has been dissolved is prepared, then, the above-described oil phase is poured to this solution, and emulsifying dispersion is conducted by means of a homogenizer and the like. In this process, the water-soluble polymer acts as a stabilizer for the emulsifying dispersion. For conducting the emulsifying dispersion more stably, a surfactant may be added at least one of the oil phase and aqueous phase.

The amount used of the polyvalent isocyanate is determined so that the average particle size of a micro capsule is from 0,3 to 12 $\mu$m and the wall thickness is from 0.01 to 0.3 $\mu$m. The dispersed particle size is generally from about 0.2 to 10 $\mu$m. In the emulsified dispersion, polymerization reaction of the polyvalent isocyanate occurs at the interface between the oil phase and the aqueous phase to form a polyurea wall.

If a polyol is previously added to the aqueous phase, the polyisocyanate can react with the polyol to form a polyurethane wall. For increasing the reaction speed, it is preferable to keep the reaction temperature high or a suitable polymerization catalyst is added. The polyisocyanate, polyol, reaction catalyst or polyamine for forming a part of a wall material are described in detail in literatures (Keiji Iwata, POLYURETHANE HANDBOOK, Nikkan Kogyo Shinbun Publishing Co., (1987)).

As the polyvalent isocyanate compound used as the raw material of a micro capsule wall, a compound having a tri- or more-functional isocyanate group is preferable, and a bi-functional isocyanate compound may be used together. Specifically, diisocyanates such as xylene diisocyanate and hydrogenated compound thereof, hexamethylene diisocyanate, tolylene diisocyanate and hydrogenated compound thereof, isophorone diisocyanate and the like as main raw materials, and a dimer or trimer (biuret or isocyanurate) thereof, and further a polyfunctional compound which is an adduct of a polyol such as trimethylolpropane with a bi-functional isocyanate such as xylinene diisocyanate, a compound obtained by introducing a polymer compound such as a polyether and the like having an active hydrogen such as polyethylene oxide into an adduct of a polyol such as trimethylolpropane with a bi-functional isocyanate such as xylinene diisocyanate, formalin condensate of benzene isocyanate, and the like may be cited.

Compounds described in Japanese Patent Application Laid-Open (JP-A) Nos. 62-212,190, 4-26,189, 5-317,694, Japanese Patent Application No. 8-268,721 and the like are preferable.

Further, it is also possible that a polyol or polyamine is previously added into a hydrophobic solvent which will become a core or a water-soluble polymer solution which will become a dispersing medium, and the mixture is used as one raw material of a micro capsule wall. Specific examples of these polyol and polyamine include propylene glycol, glycerin, trimethylolpropane, triethanolamine, sorbitol, hexamethylenediamine and the like. When a polyol is added, a polyurethane wall is formed.

As the hydrophobic organic solvent into which the above-described diazonium salt compound is dissolved for forming the core of a micro capsule, an organic solvent having a boiling point of 100 to 300° C. is preferable, and specific examples thereof include an alkylnaphthalene, alkyldiphenylethane, alkyldiphenylmethane, alkylbiphenyl, alkylterphenyl, paraffin chloride, phosphate esters, maleate esters, adipate esters, phthalate esters, benzoate esters, carbonate esters, ethers, sulfate esters, sulfonate esters and the like. These may be used in admixture of two or more.

When a diazonium salt compound to be capsulated has inferior solubility in these solvents, there can also be used as an auxiliary material a solvent having low boiling point into which a diazo compound to be used is solved with high solubility. Specific examples thereof include ethyl acetate, butyl acetate, methylene chloride, tetrahydrofuran, acetonitrile, acetone and the like. For this, it is preferable that the diazonium salt compound has appropriate solubility in these hydrophobic organic solvent having high boiling point and auxiliary solvent having low boiling point, and specifically, preferably has a solubility of 5% or more into these solvents. The solubility in water is preferably 1% or less.

As the water-soluble polymer used in the water-soluble aqueous polymer solution into which the oil phase of a capsule thus prepared is dispersed, a water-soluble polymer having a solubility in water of 5% or less at temperature at which emulsification is to be conducted is preferable, and specific examples thereof include polyvinyl alcohol and denatured compound thereof, polyacrylic amide and its derivative, ethylene-vinyl acetate copolymer, styrene-maleic anhydride copolymer, ethylene-maleic anhydride copolymer, isobutylene-maleic anhydride copolymer, polyvinylpyrrolidone, ethylene-acrylic acid copolymer, vinyl acetate-acrylic acid copolymer, carboxymethylcellulose, methylcellulose, casein, gelatin, starch derivative, gum arabic, sodium alginate and the like.

It is preferable that these water-soluble polymers have no reactivity or lower reactivity with a isocyanate compound, and for example, regarding a compound having in the molecular chain a reactive amino group such as gelatin, it is necessary to remove the reactivity by previous modification and the like.

When a surfactant is added, it is preferable that the amount added of the surfactant is from 0.1% to 5%, particularly from 0.5% to 2% based on the weight of an oil phase.

For emulsification, known emulsification apparatuses can be used such as a homogenizer, Mantonghory, ultrasonic dispersing machine, dissolver, Kedy mill and the like. After the emulsification, the emulsified material is heated at 30 to 70° C. for promoting capsule wall forming reaction. During the reaction, it is necessary to decrease the probability of mutual collision of the capsule by adding water or conduct sufficient stirring for preventing mutual flocculation of the capsule.

Further, a dispersing material for preventing flocculation may be added again during the reaction. With the progress of the polymerization reaction, generation of a carbon dioxide gas is observed, and the termination of the gas generation can be approximately regarded as the completion of the capsule wall forming reaction. Usually, an intended micro capsule including a diazonium salt compound can be obtained by reaction for several hours.

It is also possible that the coupler used in the present invention is dispersed in solid state with a basic substance, other color developing aids and the like by a sand mill and the like with a water-soluble polymer and the resulted dispersion is used, however, it is preferable that the coupler is dissolved in an organic solvent which is poorly soluble or insoluble in water, then, this is mixed with an aqueous phase having a surfactant and/or water-soluble polymer as a protection colloid to form an emulsified dispersion. For making easy the emulsifying dispersion, it is preferable to use a surfactant.

The organic solvent used in this case can be suitably selected, for example, from oils having high boiling point described in JP-A No. 2-141,279.

Among them, use of esters is preferable from the viewpoint of emulsifying stability of an emulsified dispersion, and among others, tricresyl phosphate is particularly preferable.

It is also possible to use it with the above-described oil or other oil.

To the above-described organic solvent, an auxiliary solvent can also be added as a solution aid having low boiling point. As such auxiliary solvent, for example, ethyl acetate, isopropyl acetate, butyl acetate, methylene chloride and the like can be listed as preferable examples. Depending on the occasions, it is also possible to use only a lowboiling point auxiliary solvent which does not contain high boiling point oil.

The water-soluble polymer contained as a protective colloid in an aqueous phase to be mixed with an oil phase containing these components can be appropriately selected from known anionic polymers, nonionic polymers and ampholytic polymers. As the preferable water-soluble polymer, for example, polyvinyl alcohol, gelatin, cellulose derivative and the like are listed.

As the surfactant to be contained in an aqueous phase, an agent which does not react with the above-described colloid to cause precipitation and flocculation is suitably selected from anionic or nonionic surfactants. As the preferable surfactant, sodium alkylbenzenesulfonate, sodium alkylsulfate, dioctyl sulfosuccinate sodium salt, polyalkylene glycol (for example, polyoxyethylenenonylphenyl ether) and the like are listed.

In the present invention, an organic base can also be added for the purpose of promoting the coupling reaction between a diazonium salt compound with a coupler. These organic bases can be used alone or in combination of two or more. As the basic substance, nitrogen-containing compounds such as tertiary amines, piperidines, piperazines, amidines, formamidines, piridines, guanidines, morpholines and the like are listed. Those described in Japanese Patent Application Publication (JP-B) No. 52-46,806, JP-A Nos. 62-70,082, 57-169,745, 60-94,381, 57-123,086, 58-1,347,901, 60-49,991, JP-B Nos. 2-24,916, 2-28,479, JP-A No. 60-165,288 and 57-185,430 can also be used.

Among them, particularly, piperazinessuch as N,N'-bis(3-phenoxy-2-hydropropyl)piperazine, N,N'-bis[3-(p-methylphenoxy)-2-hydroxypropyl]piperazine, N,N'-bis[3-(p-methoxyphenoxy)-2-hydroxypropyl]piperazine, N,N'-bis(3-phenylthio-2-hydroxypropyl)piperazine, N,N'-bis[3-(β-naphthoxy)-2-hydroxypropyl]piperazine, N-3-(β-naphthoxy)-2-hydroxypropyl-N'-methylpioperazine, 1,4-bis{[3-(N-methylpiperazino)-2-hydroxyl]propyloxy}benzene and the like, morpholines such as N-[3-(β-naphtoxy)-2-hydroxy]propylmorpholine, 1,4-bis(3-morpholino-2-hydroxy-propyloxy)benzene, 1,3-bis(3-morpholino-2-hydroxy-propyloxy)benzene and the like, piperidines suh as N-(3-phenoxy-2-hydroxypropyl)piperidine, N-dodecylpiperidine and the like, guanidines such as triphenylguanidine, tricyclohexylguanidine, dicyclohexylphenylguanidine, and the like, are preferable.

In the present invention, the amounts used of the coupler and the basic substance based on 1 part by weight of the diazonium salt compound are respectively from 0.1 to 30 parts by weight.

In the present invention, a color developing aid can be added for the purpose of promoting color developing reaction, in addition to the above-described organic bases. The color developing aid is a substance which enhances developed color concentration in heating and recording, or lowers the minimum color developing temperature, and used for making condition in which the diazonium salt compound, basic substance, coupler and the like react easily by the action for reducing the melting point of the coupler, basic substance, diazonium salt compound or the like or reducing the softening point of the capsule wall.

As the color developing aid used in the present invention, for example, a phenol derivative, naphthol derivative, alkoxy-substituted benzenes, alkoxy-substituted naphthalenes aromatic ether, thioether, ester, amide, ureide, urethane, sulfoneamide compound, hydroxy compound and the like can be added into a color developing layer so that heat printing can be conducted quickly and completely with lower energy.

In the heat-sensitive recording material of the present invention, it is preferable that known antioxidants shown below and the like are used for the purpose of improving durability of a thermally color developed image against a light and heat or reducing yellowing by a light of unprinted parts after fixing.

The above-described antioxidants are described, for example, in EP-A Nos. 223,739, 309,401, 309,402, 310,551, 310,552 and 459,416, DE-A No. 3,435,443, JP-A No. 54-48,535, 62-262,047, 63-113,536, 63-163,351, 2-262,654, 2-71,262, 3-121,449, 5-61,166 and 5-119,449, U.S. Pat. Nos. 4,814,262 and 4,980,275, and the like.

Further, in the present invention, it is also effective to use known various additives which are previously used in heat-sensitive recording materials and pressure sensitive recording materials. As specific examples of these various additives, there can be listed compounds described in JP-A Nos. 60-107,384, 60-107,383, 60-125,470, 60-125,471, 60-125,472, 60-287,485, 60-287,486, 60-287,487, 60-287,488, 61-160,287, 61-185,483, 61-211,079, 62-146,678, 62-146,680, 62-146,679, 62-282,885, 63-051,174, 63-89,877, 63-88,380, 63-088,381, 63-203,372, 63-224,989, 63-251,282, 63-267,594, 63-182,484, 1-239,282, 4-291,685, 4-291,684, 5-188,687, 5-188,686, 5-110,490, 5-1,108,437 and 5-170,361, JP-B Nos. 48-043,294 and 48-033,212, and the like.

Specific examples thereof include 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-teterahydroquinoline, nickel cyclohexanoate, 2,2-bis(4-hydroxyphenyl)propane, 1,1-bis(4-hydroxyphenyl)-2-ethylhexane, 2-methyl-4-methoxydiphenylamine, 1-methyl-2-phenylindol and the like.

It is preferable that the amounts added of these antioxidants and various additives are preferably from 0.05 to 100 parts by weight, particularly from 0.2 to 30 parts by weight based on 1 part by weight of the diazonium salt compound.

These known antioxidants and various additives can be contained in a micro capsule with the diazonium compound, or can be used in the form of a solid dispersion together with the coupler, basic substance and other color developing aid or in the form of an emulsion with a suitable emulsifier, or both embodiments can be applied simultaneously. It is not to mention that the antioxidants and various additives can be used alone or in combination of two or more. Further, these can be added to or allowed to exist in a protective layer.

These antioxidants and various additives need not be added to the same layer. Further, when these antioxidants and various additives are used in combination of two or more, it is possible that these are classified by structure for example into anilines, alkoxybenzenes, hindered phenols, hindered amines, hydroquinoline derivatives, phosphorus compounds, and sulfurcompounds, andcompoundshavingdifferentstructuresmay be combined or a plurality of compounds having the same structure can be combined.

To the heat-sensitive recording material of the present invention, a free radical generating agent (a compound which generates a free radical by irradiation with a light) used in a light-polymerizable composition and the like can be added for the purpose of reducing yellowing of ground parts after recording. As the free radical generating agent, aromatic ketones, quinones, benzoin, benzoin ethers, azo compound, organic disulfides, acyloxime esters and the like are listed. The amount added of the free radical generating agent is preferably from 0.01 to 5 parts by weight based on 1 part by weight of the diazonium salt compound.

Likewise, for the purposed of reducing yellowing, a polymerizable compound having ethylenically unsaturated bond (hereinafter, referred to as a vinyl monomer) can also be used. The vinyl monomer is a compound having in the chemical structure at least one ethylenically unsaturated bond (vinyl group, vinylidene group and the like), and having chemical form of a monomer or prepolymer. As examples thereof, unsaturated carboxylic acids and salts thereof, esters of unsaturated carboxylic acids with aliphatic polyhydric alcohols, amides of unsaturated carboxylic acids with aliphatic polyhydric amine compounds, and the like are listed. The vinyl monomer is used in an amount of 0.2 to 20 parts by weight based on 1 part by weight of the diazonium salt compound.

The above-described free radical generating agent and vinyl monomer can also be contained in a micro capsule together with the diazonium salt compound.

In the present invention, citric acid, tartaric acid, oxalic acid, boric acid, phosphoric acid, pyrophosphoric acid and the like can be added as an acid stabilizer, in addition to the above-described raw materials.

For producing the heat-sensitive recording material of the present invention, it is preferable that a coating solution containing a micro capsule containing a diazonium salt compound, coupler, organic base and other additives is prepared, and this solution is coated ona substrate such as paper, synthetic resin film and the like by a coating method such as bar coating, blade coating, air knife coating, gravure coating, roll coating, spray coating, dip coating, curtain coating and the like, and dried to provide a heat-sensitive layer having a solid content of 2.5 to 30 g/m$^2$.

In the heat-sensitive recording material of the present invention, a micro capsule, coupling component, base and the like may be contained in the same layer, however, a layered constitution in which they are contained in separate layers may be adopted. Further, it is also possible that an intermediate layer as described in Japanese Patent Application 59-177,669 is coated in a substrate, then, the heat-sensitive layer is coated.

As the binder used in the heat-sensitive recording material of the present invention, known water-soluble polymer compounds, latexes and the like can be used. Examples of the water-soluble polymer compound include methylcellulose, carboxymethylcellulose, hydroxyethylcellulose, hydroxypropylcellulose, starch derivatives, casein, gum arabic, gelatin, ethylene-maleic anhydride copolymer, styrene-maleic anhydride copolymer, polyvinyl alcohol, epichlorhydrin modified polyamide, isobutylenemaleinsalicylic anhydride copolymer, polyacrylic acid, polyacrylic amide and modified materials thereof, and examples of the latexes include styrene-butadiene rubber latex, methyl acrylate-butadiene rubber latex, vinyl acetate emulsion, and the like.

The pigment which can be used in the heat-sensitive recording material of the present invention, known materials can be used whether they are organic or inorganic. Specific examples thereof include kaolin, calcined kaolin, talc, pyrophilite, diatomaceous earth, calcium carbonate, aluminum hydroxide, magnesium hydroxide, zinc oxide, lithopone, amorphous silica, colloidal silica, calcined zypsum, silica, magnesium carbonate, titanium oxide, alumina, barium carbonate, barium sulfate, mica, micro balloon, urea-formalin filler, polyester particle, cellulose filler and the like.

In the heat-sensitive recording material of the present invention, various additives such as known wax, antistatic agent, defoaming agent, conducting agent, fluorescent dye, surfactant, ultraviolet absorber and precursors thereof can be used, according to demands.

In the heat-sensitive recording material of the present invention, a protective layer may be provided if necessary on the surface of the recording layer. If necessary, two or more protective layers may be laminated. As the material used for the protective layer, water-soluble polymer compounds such as polyvinyl alcohol, carboxy-denatured polyvinyl alcohol, vinyl acetate-acrylamide copolymer, silicon-denatured polyvinyl alcohol, starch, modified starch, methylcellulose, carboxymethylcellulose, hydroxymethylcellulose, gelatins, gum arabic, casein, styrene-maleic acid copolymer hydrolyzate, styrene-maleic acid copolymer half ester hydrolyzate,isobutylene-maleic anhydride copolymer hydrolyzate, polyacrylamide derivative, polyvinylpyrrolidone, sodium polystyrenesulfonate, sodium alginate and the like, and latexes such as styrene-butadiene rubber latex, acrylonitrile-butadiene rubber latex, methyl acrylate-butadiene rubber latex, vinyl acetate emulsion and the like can be used. The water-soluble polymer compound in the protective layer can also bee crosslinked to further improve storage stability, and as the crosslinking agent, known crosslinking agents can be used. Specific examples thereof include water-soluble initial condensates of N-methylolurea, N-methylolmelamine, urea-formalin and the like, dialdehyde compounds such as glyoxal, glutaraldehyde and the like, inorganic crosslinking agents such as boric acid, borax and the like, polyamide epichlorhydrin and the like. In the protective layer, a known pigment, metal soap, wax, surfactant and the like can further ba used. The amount coated of the protective layer is preferably from 0.2 to 5 g/m$^2$, and further preferably from 0.5 to 2 g/m$^2$. The film thickness is preferably from 0.2 to 5 $\mu$m, and particularly preferably from 0.5 to 2 $\mu$m.

When a protective layer is used in the heat-sensitive recording material of the present invention, the protective layer may contain a known ultraviolet absorbing agent and precursors thereof.

As the substrate of the present invention, any of paper substrates used for usual pressure sensitive paper and heat-sensitive paper, dry or wet diazo copy paper can bee used, and in addition, acidic paper, neutral paper, coat paper, plastic film laminate, synthetic paper, plastic film and the like can be used.

A back coat layer may be provided for the purpose of correcting curl balance of the substrate or improving chemical resistance from the rear surface, and alternatively, peeling paper may also be combined via an adhesive layer onto the rear surface to provide label form. This back coat can also be provided in the same manner as for the above-described protective layer.

The recording surface of the heat-sensitive recording material of the present invention is heated by a thermal head and the like, a capsule wall made of a polyurea and/or polyurethane is softened, and a coupler and basic compound out of the capsule invade into the capsule to develop color. After color development, fixation of an image is conducted by irradiation with a light having an absorption wavelength of the dazonium salt compound since then the diazonium salt compound is decomposed and lose reactivity with the coupler.

As the fixing light source, various fluorescent lamps, xenon lamps, mercury lamps and the like are used, it is preferable that this emission spectrum approximately coincides with the absorption spectrum of the diazonium salt compound used in the heat-sensitive recording material since then effective fixation is obtained.

In the present invention, a fixing light source having an emission center wavelength of 360 to 440 nm is particularly preferable.

In the present invention, a multi-color recording material can also be obtained by using a light-decomposable diazonium salt compound having the different light decomposition wavelength in the different layer.

When the heat-sensitive recording material of the present invention is formed as a multi-layer multi-color heat-sensitive recording material, an intermediate layer can also be provided for preventing color mixing between the light sensitive and heat-sensitive recording layers. This intermediate layer is composed of a water-soluble polymer compound such as gelatin, phthalated gelatin, polyvinyl alcohol, polyvinylpyrrolidone and the like, and may appropriately contain various additives.

EXAMPLES

The following examples further illustrate the present invention in detail, but do not limit the present invention. In the examples, "parts" are "parts by weight" unless otherwise stated.

Example 1

(Preparation of micro capsule solution A containing diazonium salt)

To 19 parts of ethyl acetate was added 2.8 parts of a diazonium salt compound (A-1) and 10 parts of tricresyl phosphate and the mixture was stirred uniformly. Then, to this mixture was added 7.6 g of TAKENATE D110N (manufactured by Takeda Chemical Industries, Ltd.) and mixed to obtain I solution. Then this I solution was added to a mixture of 46 parts of 8% aqueous solution of phthalated gelatin, 17.5 parts of water and 2 pats of 10% aqueous solution of sodium dodecylbenzenesulfonate, and the mixture was emulsified and dispersed for 10 minutes at 10000 rpm at 40° C. by using a homogenizer. To the resulted emulsion was added 20 parts of water and the mixture was made into uniform, then, capsule forming reaction was conducted for 3 hours at 40° C. with stirring to obtain a capsule solution A. The particle size of the capsule was from 0.7 to 0.8 micrometer.

(Preparation of coupler emulsion B)

Into 10.5 parts of ethyl acetate was dissolved 3 parts of a coupler (K-1), 3 parts of triphenylguanidine, 0.5 parts of tricresyl phosphate and 0.24 parts of diethyl maleate to obtain II solution.

Then, 49 parts of 15% aqueous solution of lime-treated gelatin, 9.5 parts of 10% aqueous solution of sodium dodecylbenzenesulfonate, and 35 parts of water were mixed uniformly at 40' C. and to this mixture was added the II solution, and the resulted mixture was emulsified and dispersed for 10 minutes at 10000 rpm at 40° C. by using a homogenizer. The resulted emulsion was stirred for 2 hours at 40° C. to remove ethyl acetate, then, the amount of evaporated ethyl acetate and water were compensated by addition of water to obtain a coupler emulsion B.

(Preparation of light-sensitive and heat-sensitive recording layer coating solution C)

3.6 parts of the capsule solution A, 3.3 parts of water and 9.5 parts of the coupler emulsion B were mixed to obtain a light-sensitive and heat-sensitive recording layer coating solution C.

(Preparation of protective layer coating solution D)

15 parts of a 40% zinc stearate (HYDRIN ZZ; trade name, manufactured by Chukyo Yushi K. K.) dispersion was uniformly mixed into a mixture of 100 parts of a 6% aqueous itaconic acid-denatured polyvinyl alcohol solution (KL-318; trade name, manufactured by Kuraray Co., Ltd.) and 10 parts of a 30% epoxy-modified polyamide (FL-71; trade name, manufactured by Toho Kagaku K. K.) dispersion, to obtain a protective layer coating solution D.

(Coating)

The heat-sensitive recording layer coating solution C and the protective layer coating solution D were sequentially coated in this order on a substrate for developing paper made by laminating polyethylene on high quality paper and were dried at 50° C. to obtain an intended heat-sensitive recording material. The amounts coated in terms of solid components were 8.0 g/m$^2$ and 1.2 g/m$^2$ respectively.

(Color developing test)

A thermal head manufactured by Kyocera Corp. (KST type) was used and developing electric power and pulse width were determined for the thermal head so that the recording energy was 50 mj/mm$^2$, and heat development was conducted on a heat-sensitive recording material to obtain an image. Then the image was exposed to a ultraviolet lamp having a light emitting center wavelength of 420 nm and an output of 40 W for 10 seconds. From the resulted color developed image, the absorption maximum wavelength in visible range and half breadth (value of absorption wavelength range at an absorbancy of 0.5 when the absorbancy at maximum absorption is standadized to 1.0) were measured.

Example 2

The same procedure as in Example 1 was conducted except that K-2 was used as the coupler, to prepare a heat-sensitive recording material and it was evaluated.

Example 3

The same procedure as in Example 1 was conducted except that A-44 was used as the diazonium salt compound, to prepare a heat-sensitive recording material and it was evaluated.

Example 4

The same procedure as in Example 1 was conducted except that K-4 was used as the coupler, to prepare a heat-sensitive recording material and it was evaluated.

Example 5

The same procedure as in Example 1 was conducted except that K-5 was used as the coupler, to prepare a heat-sensitive recording material and it was evaluated.

Example 6

The same procedure as in Example 1 was conducted except that A-46 was used as the diazonium salt compound, to prepare a heat-sensitive recording material and it was evaluated.

Comparative Example 1

The same procedure as in Example 1 was conducted except that H-1 was used as the coupler, to prepare a heat-sensitive recording material and it was evaluated.

H-1

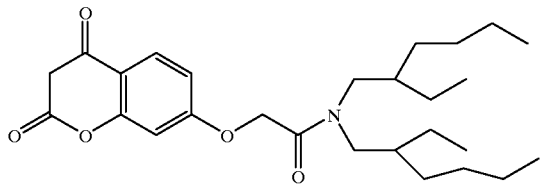

(Exemplified compound B-13 in Japanese Patent Application No. 9-152,414)

The results of Examples 1 to 6 and Comparative Example 1 are shown in Table 1 below.

TABLE 1

| | Coupler | Diazonium salt compound | Absorption maximum (nm) | Half breadth (nm) |
|---|---|---|---|---|
| Example 1 | K-1 | A-1 | 545.2 | 117.5 |
| Example 2 | K-2 | A-1 | 544.0 | 120.5 |
| Example 3 | K-1 | A-44 | 538.3 | 118.2 |
| Example 4 | K-4 | A-1 | 540.2 | 119.3 |
| Example 5 | K-5 | A-1 | 551.3 | 119.8 |
| Example 6 | K-1 | A-46 | 539.2 | 117.8 |
| Comparative example 1 | H-1 | A-1 | 532.1 | 155.7 |

From the results, it is found that color developed images having extremely sharp absorption property are obtained when the heat-sensitive recording materials of the present invention are used.

Example 7

The absorption maximum wavelength and half breadth (explained above) of the solution absorption (chloroform/methanol=1/1) of a pigment obtained from the coupler (K-1) and the diazonium salt compound (A-1) were measured.

Example 8

The solution absorption of a pigment obtained from the coupler (K- 2) and the diazonium salt compound (A-1) was measured in the same manner as in Example 7.

Example 9

The solution absorption of a pigment obtained from the coupler (K-3) and the diazonium salt compound (A-1) was measured in the same manner as in Example 7.

Example 10

The solution absorption of a pigment obtained from the coupler (K-4) and the diazonium salt compound (A-1) was measured in the same manner as in Example 7.

Example 11

The solution absorption of a pigment obtained from the coupler (K-5) and the diazonium salt compound (A-1) was measured in the same manner as in Example 7.

Example 12

The solution absorption of a pigment obtained from the coupler (K-1) and the diazonium salt compound (A-44) was measured in the same manner as in Example 7.

Comparative Example 2

The solution absorption of a pigment obtained from a coupler (compound (B) described below) and the diazonium salt compound (A-1) was measured in the same manner as in Example 7.

Compound (B)

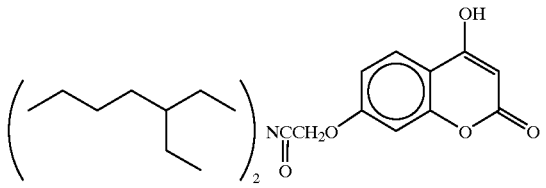

Comparative Example 3

The solution absorption of a pigment obtained from the coupler (compound (B)) and the diazonium salt compound (A-44) was measured in the same manner as in Example 7.

Comparative Example 4

The solution absorption of a pigment obtained from a coupler (compound (C) described below) and the diazonium salt compound (A-44) was measured in the same manner as in Example 7.

Compound (C)

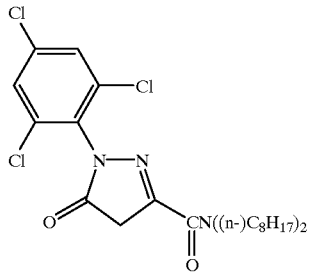

The results of Examples 7 to 12 and Comparative Examples 2 to 4 are shown in Table 2 below.

TABLE 2

Comparison of abilities in view of pigment absorption

| | Coupler | Diazonium salt compound | Pigment absorption ($CHCl_3$3/MeOH = 1/1, ratio by volume) Absorption maximum (nm) | Half breadth (nm) |
|---|---|---|---|---|
| Example 7 | K-1 | A-1 | 535 | 92 |
| Example 8 | K-2 | A-1 | 530 | 96 |
| Example 9 | K-3 | A-1 | 545 | 98 |
| Example 10 | K-4 | A-1 | 528 | 92 |
| Example 11 | K-5 | A-1 | 541 | 97 |

TABLE 2-continued

Comparison of abilities in view of pigment absorption

| | Coupler | Diazonium salt compound | Pigment absorption ($CHCl_3$3/MeOH = 1/1, ratio by volume) Absorption maximum (nm) | Half breadth (nm) |
|---|---|---|---|---|
| Example 12 | K-1 | A-44 | 525 | 93 |
| Comparative Example 2 | Compound (B) | A-1 | 534 | 119 |
| Comparative Example 3 | Compound (B) | A-44 | 519 | 117 |
| Comparative Example 4 | Compound (C) | A-44 | 503 | 126 |

As is known from Table 2, pigments obtained from the couplers in the comparative examples (compound (B) (coumarin), compound (C) (pyrazolone)) give broad absorption and dark magenta color, while all of the couplers of the present invention give sharp absorption and bright magenta color, therefore, the usefulness of the present invention is apparent.

The present invention can provide a light-sensitive and heat-sensitive recording material giving no fixation disturbance, and having excellent color developing property, color reproducing ability and image durability, and further, can provide a coupler giving a magenta pigment excellent in hue even if a diazonium salt compound which can be fixed at a wavelength around 420 nm is used.

What is claimed is:

1. A heat-sensitive recording material comprising a substrate carrying thereon a heat-sensitive recording layer containing a diazonium salt compound and a coupler which develops color by reacting with said diazonium salt compound in heating, wherein said coupler comprises at least one compound represented by the following general formula (1):

General formula (1)

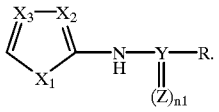

wherein Y represents a carbon atom or sulfur atom, Z represents an oxygen atom or sulfur atom, R represents an alkyl group, aryl group, heterocyclic group, alkoxy group, aryloxy group or amino group, n1 represents 1 when Y is a carbon atom and represents 1 or 2 when Y is a sulfur atom, when n1 represents 2, two Zs may be the same or different, $X_1$, $X_2$ and $X_3$ each independently represents an atom group required for forming a 5-membered aromatic heteroring wherein there is no case in which two of $X_1$, $X_2$ and $X_3$ represent a carbon atom and the remaining one represents a nitrogen atom.

2. A heat-sensitive recording material according to claim 1, wherein said diazonium salt is a compound represented by the following general formula (2):

General formula (2)

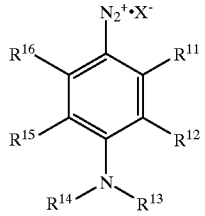

wherein $R^{11}$ represents an alkylsulfenyl group, arylsulfenyl group, alkylsulfinyl group, arylsulfinyl group, alkylsulfonyl group, arylsulfonyl group, sulfamoyl group, alkoxycarbonyl group, carbamoyl group, carboxyl group, acyl group or cyano group, $R^{13}$ and $R^{14}$ each independently represents a hydrogen atom, alkyl group or aryl group, $R^{12}$, $R^{15}$ and $R^{16}$ each independently represents a hydrogen atom, alkyl group, aryl group, alkoxy group or halogen atom, $X^-$ represents an anion, and $R^{13}$ and $R^{14}$, $R^{12}$ and $R^{13}$, or $R^{14}$ and $R^{15}$ may bond each other to form a ring.

3. A heat-sensitive recording material according to claim 2, wherein said diazonium compound is encapsulated in a micro capsule.

4. A heat-sensitive recording material according to claim 1, wherein said diazonium salt is a compound represented by the following general formula (3):

General formula (3)

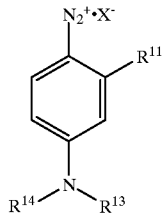

wherein $R^{11}$ represents an alkylsulfenyl group, arylsulfenyl group, alkylsulfinyl group, arylsulfinyl group, alkylsulfonyl group, arylsulfonyl group, sulfamoyl group, alkoxycarbonyl group, carbamoyl group, acyl group or cyano group, $R^{13}$ and $R^{14}$ each independently represents a hydrogen atom, alkyl group or aryl group, $X^-$ represents an anion, and $R^{13}$ and $R^{14}$ may bond each other to form a ring.

5. A heat-sensitive recording material according to claim 4, wherein said diazonium compound is encapsulated in a micro capsule.

6. A heat-sensitive recording material according to claim 1, wherein said diazonium compound is encapsulated in a micro capsule.

7. A heat-sensitive recording material according to claim 1, wherein said diazonium salt is a compound represented by the following general formula (4):

General formula (4)

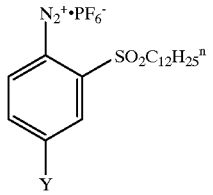

wherein Y represents

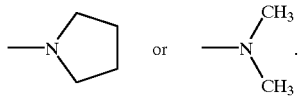

8. A heat-sensitive recording material according to claim 7, wherein said diazonium compound is encapsulated in a micro capsule.

9. A heat-sensitive recording material according to claim 1, wherein said coupler is a compound represented by the following general formula (5):

General formula (5)

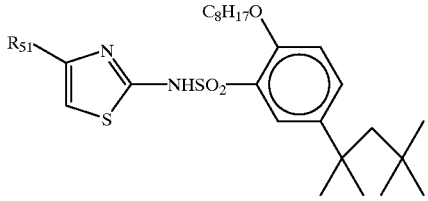

wherein $R_{51}$ represents

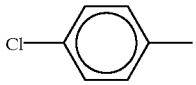

group,

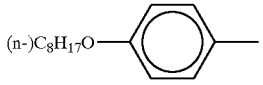

group,

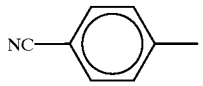

group,

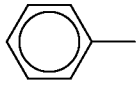

group or

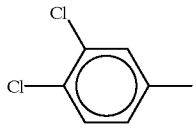

group.

10. A heat-sensitive recording material according to claim 9, wherein said diazonium compound is encapsulated in a micro capsule.

* * * * *